US005150908A

United States Patent [19]

Codinha

[11] Patent Number: 5,150,908

[45] Date of Patent: Sep. 29, 1992

[54] MILITARY CONFLICT BOARD GAME

[76] Inventor: J. Albert Codinha, 9260 Towne Center Dr., #27, San Diego, Calif. 92121-3008

[21] Appl. No.: 753,306

[22] Filed: Aug. 30, 1991

Related U.S. Application Data

[63] Continuation-in-part of Ser. No. 347,289, May 4, 1989.

[51] Int. Cl.[5] ..... A63F 3/00

[52] U.S. Cl. ..... 273/262; 273/255

[58] Field of Search ..... 273/255, 262, 256, 257

[56] References Cited

U.S. PATENT DOCUMENTS

| | | | |
|---|---|---|---|
| 1,149,918 | 8/1915 | Johnson et al. | 273/262 |
| 2,273,292 | 2/1942 | Smith | 273/255 |
| 2,464,819 | 3/1949 | Lieberman | 273/262 |
| 3,368,816 | 2/1968 | Milazzo et al. | 273/257 |
| 3,756,604 | 9/1973 | Laszlo | 273/256 |
| 4,765,627 | 8/1988 | Ross | 273/255 |
| 5,009,430 | 4/1991 | Yuhasz | 273/255 |

*Primary Examiner*—Benjamin Layno

*Attorney, Agent, or Firm*—Brown, Martin, Haller & McClain

[57] ABSTRACT

The invention herein is apparatus for a board game which simulates international military conflict. The game comprises a playing board which includes a map illustrating the principal oceans, nations and geographical area of the world with indicia assigning each nation to a continental region. The ocean portion of the map is overlaid by a first network of cells and the land portion of the map is overlaid by a second network of cells, the second network also indicating relative military strengths of the nations. Some of said nations on the map contain indicia designating missile facilities therein. The map is bordered by a path comprising spaces each identifying one of the nations on the map and other spaces denoting enhanced movement along the path. The game also contains playing pieces for individual movement by each player along the path in the course of said game; pieces representing individual military or naval forces; pieces designating nuclear annihilation of a nation; and designators determining each player's permitted movement along the path during the game. As a player moves, in most turns a military opportunity occurs for the player with respect to the other players, each opportunity being determined by the path space on which the player's piece resides and the number of other pieces, geography and missile facilities then associated with the nation represented by the path space.

12 Claims, 4 Drawing Sheets

FIG. 3
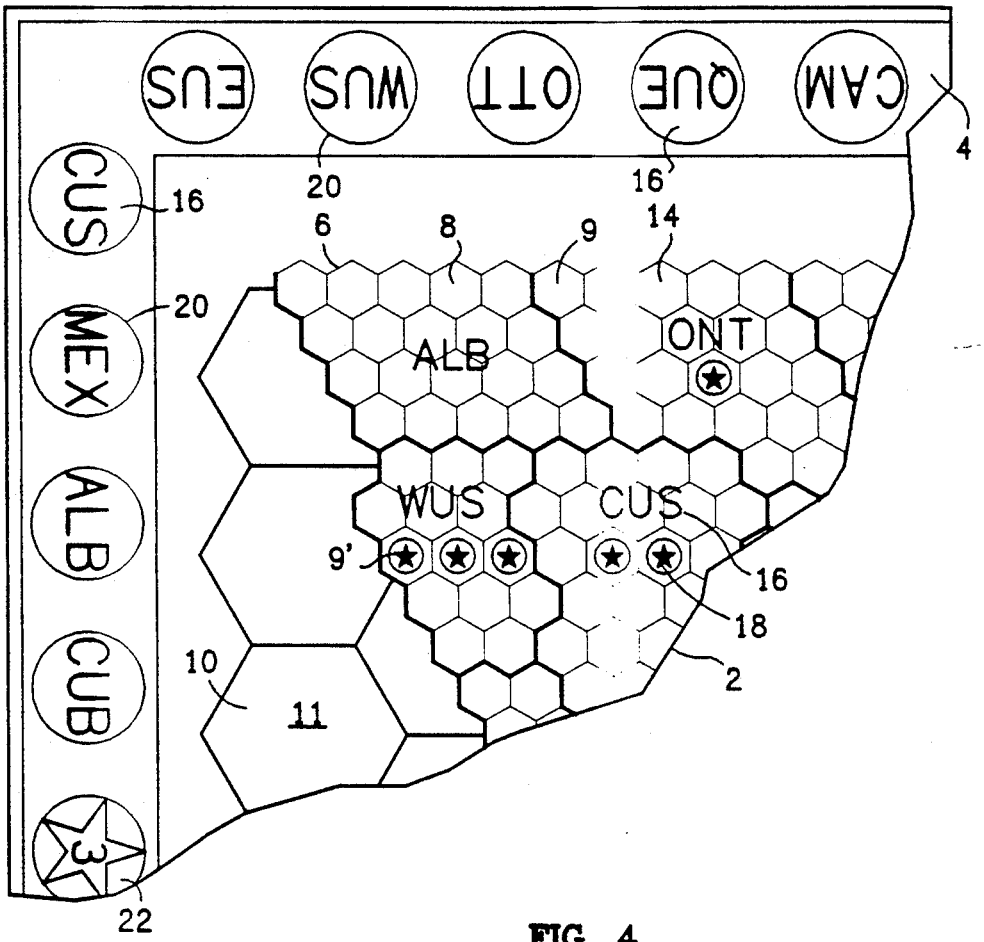
FIG. 4
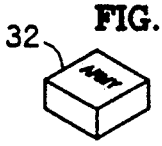
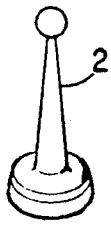
FIG. 6
FIG. 5
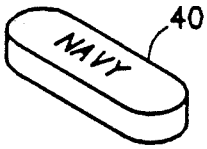
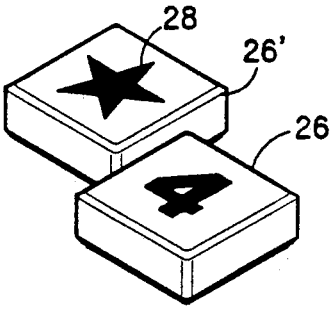
FIG. 7
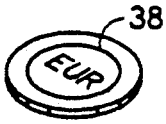
FIG. 8
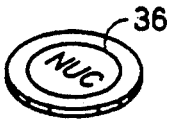
FIG. 9

MILITARY CONFLICT BOARD GAME

CROSS-REFERENCE TO RELATED APPLICATION

This application is a continuation-in-part of application Ser. No. 07/347,289, filed May 4, 1989, entitled "Economic and Military Conflict Board Game."

BACKGROUND OF THE INVENTION

1. Field of the Invention

The invention herein relates to military conflict board games, and particularly to games simulating global military conflict.

2. Description of the Prior Art

There have been a large number of prior art military conflict board games, simulating international warfare. Most, however, have been based on prior history and have reflected the conflict between individual countries. The players in such games are assigned individual countries and during the course of the game attempt to obtain allies among other countries on a somewhat random basis. Consequently, in many such games there is little organization and the eventual outcome of the game depends only on overall accumulation by players of territories scattered at random across the world.

Such games do not reflect the emerging pattern of international conflict. In many of the political and military situations of the present day, countries in a discrete regional area find that they have common interests which conflict with common interests of other regional groupings of countries. Similarly, a pattern which is emerging is that many countries in a discrete regional area will find it in their interests to either ally themselves with other countries in that region against other regions or to eliminate the opposition of countries within their region so that the region as whole can present an overall bloc of unified military strength against other regions. Such may be seen today in the Middle East and Africa. Commentators suggest that this trend will continue in the future.

It would therefore be advantageous to have a board game which allows players to simulate current and possible future political and military realities in the world, in contrast with prior art games which have concentrated on simulating the conflicts between individual countries or "super powers."

SUMMARY OF THE INVENTION

The invention herein is apparatus for a board game which simulates international military conflict. The game comprises a playing board which includes a map illustrating at least a portion of each of the principal oceans and nations of the world. The map contains indicia assigning each of the nations to one of a plurality of continental groups or regions, the regions themselves being uniquely identified. The ocean portion of the map is overlaid by a first network of cells and the land portion of the map is overlaid by a second network of cells. At least some of said nations and regions illustrated on the map contain indicia designating missile facilities therein. The map is bordered by a path comprising a first plurality of spaces each identifying one of the nations on the map and containing corresponding continental region indicia for each of the nations and regions and a second plurality of spaces denoting enhanced movement along the path.

The game also contains first playing pieces for individual movement by each player along the path in the course of said game; second playing pieces representing individual military or naval forces in a nation or ocean; third playing pieces designating nuclear annihilation of a nation; and designators determining each player's permitted movement along said path at each point in said game. Each of the first pieces when moved along said path in response to the indication of one of said designators determines a military opportunity of the player represented by that piece with respect to the other players, the opportunity being determined by the path space on which the player's first piece resides after that movement and the number of second pieces, third pieces, cells and missile facilities then associated with any nation or region indicated by the path space.

BRIEF DESCRIPTION OF THE DRAWINGS

FIG. 3 is an enlarged view of one portion of the board of FIG. 1 to further illustrate the details of the board. FIG. 4 illustrates a game piece representing an army.

FIG. 5 illustrates a game piece representing a navy.

FIG. 6 illustrates a typical game piece used by a player to indicate progress along the border path.

FIG. 7 illustrates two tiles denoting the length of a single movement along the border path.

FIG. 8 illustrates a "doubling" game piece representing unification of the nations of a continental region.

FIG. 9 illustrates a game piece used on the border path and representing the nuclear annihilation of a nation.

DETAILED DESCRIPTION AND PREFERRED EMBODIMENTS

The principles of the present board game will be best understood by considering first a description of the board itself, followed by a description of the typical play of the game.

Figure 1:
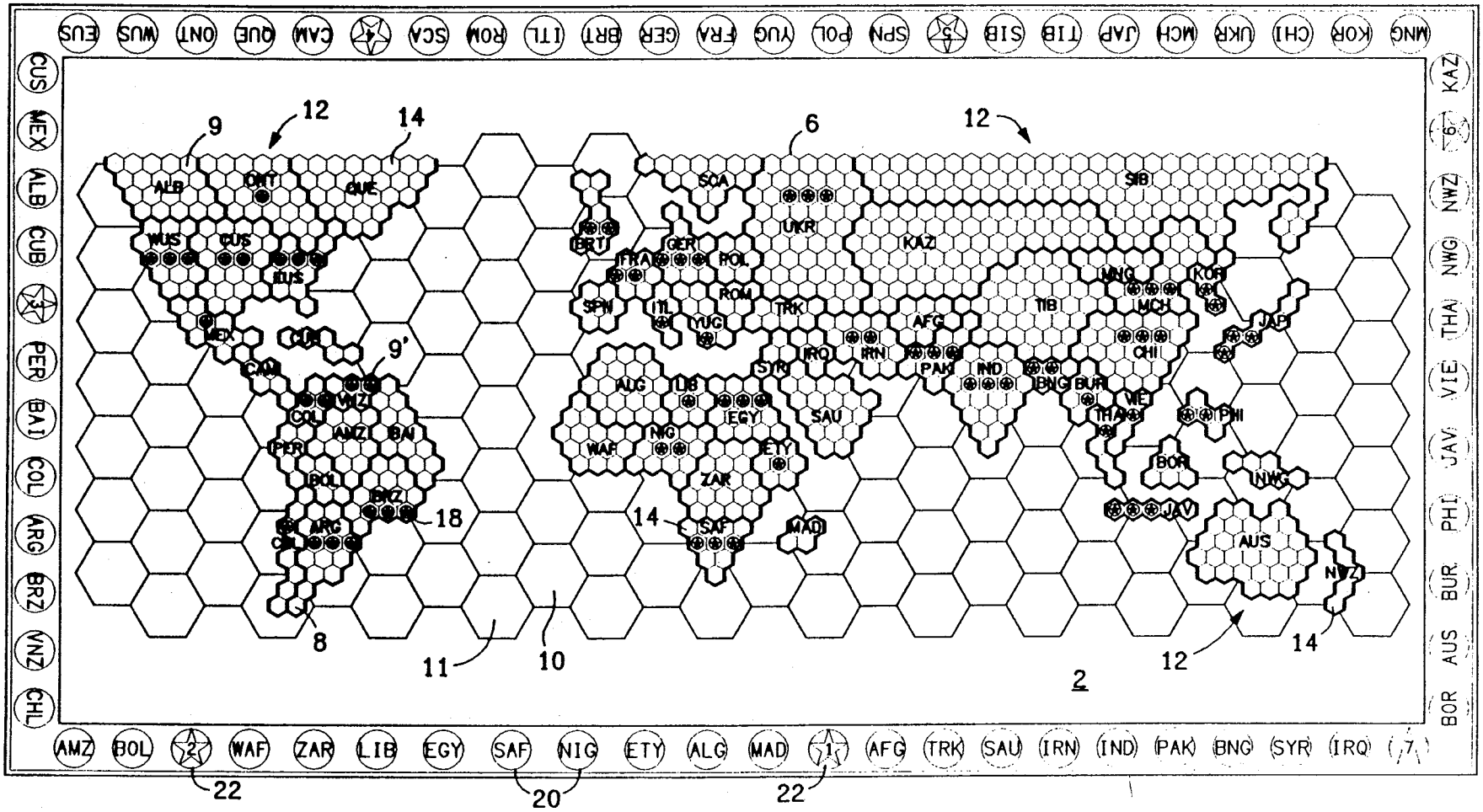
FIG. 1 is a plan view of a game board of the game apparatus of this invention illustrating both the border portion and the central map portion.
Figure 2A:
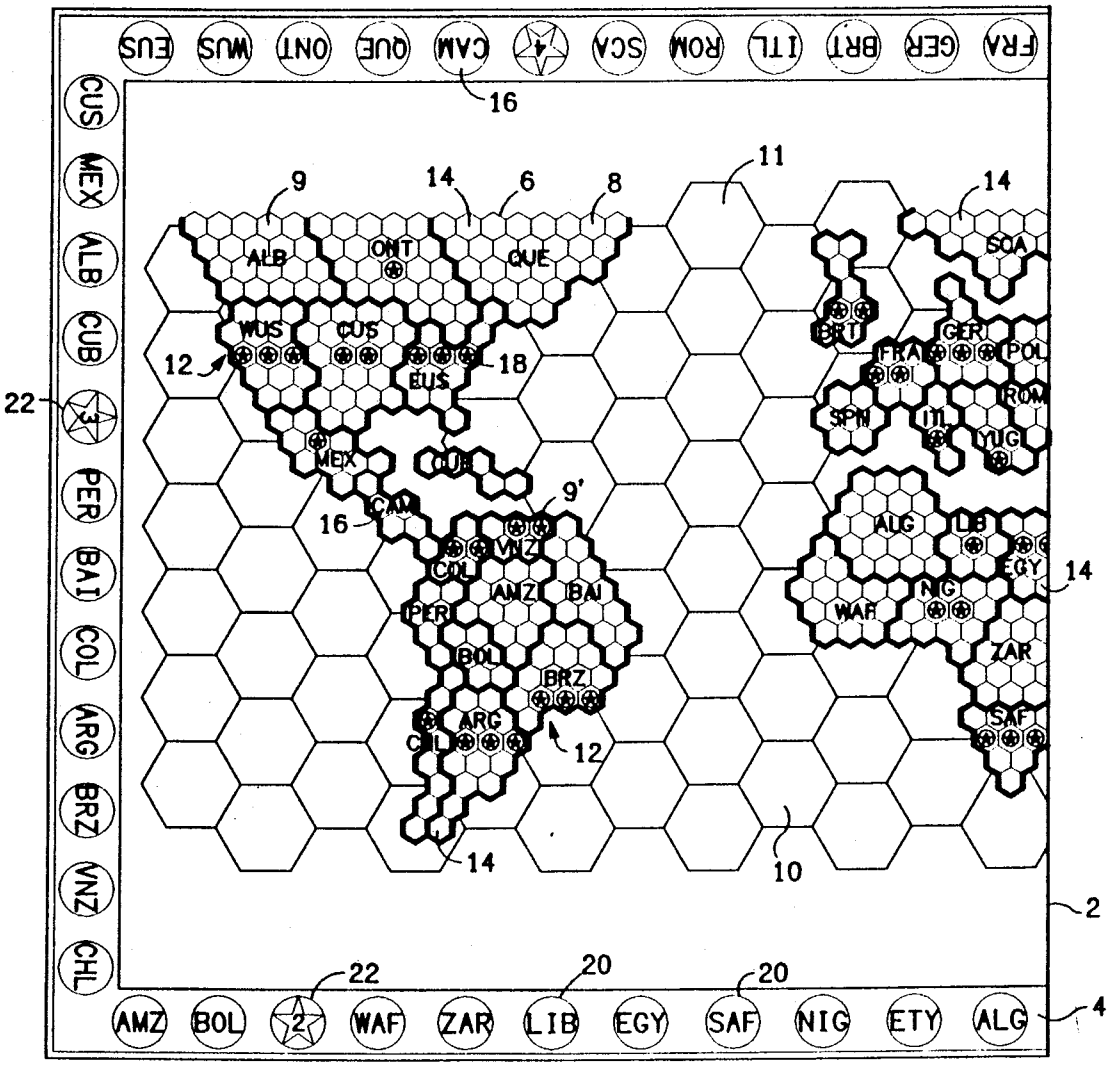
FIGS. 2*a* and 2*b* are respectively enlarged views of the two halves of the board of FIG. 1, showing in larger size the detail of the board.
Figure 2B:
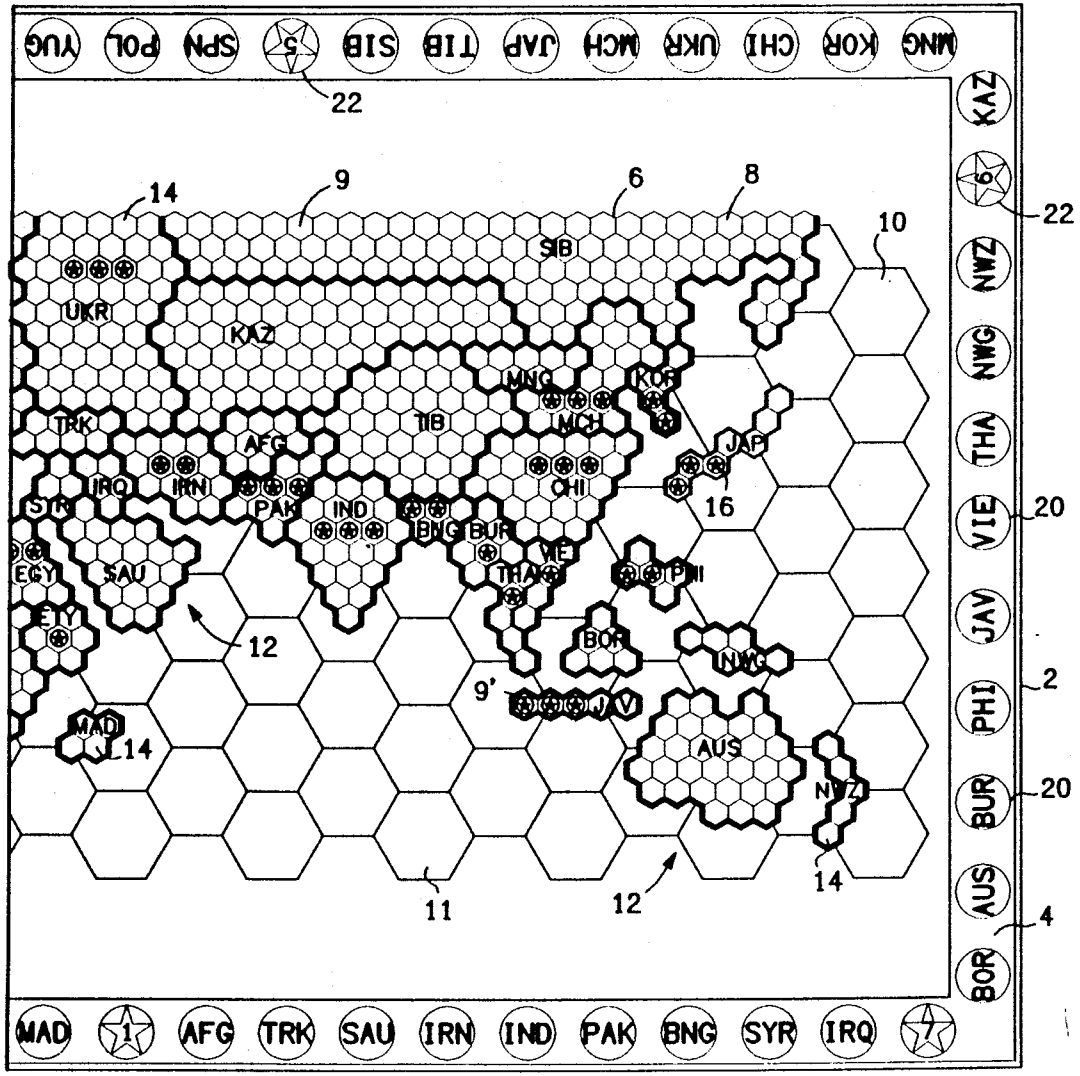

As will be seen in FIGS. 1–3, the board 2 has two separate portions, a border 4 which comprises a path around the edge of the board 2 and a central portion which represents a stylized map 6 of the world in which individual groupings of countries and portions of countries are identified. Each country, national grouping or portion of a country identified on the map 6 also has a corresponding designated space in the outer border path 4.

For brevity in this Specification and in the appended Claims, the various countries, national groupings, or portions of a country will be referred to collectively simply by the term "nation." For instance, the North American portion of the map illustrates nine sectors: Canada and the United States are both divided into thirds, Mexico and Cuba are each a entire country, and "Central America" is a grouping of seven actual countries. In the play of the game and herein, however, each of these sectors is considered and labelled as a "nation," regardless of its actual political structure. Such "nations" also generally represent political units of approximately equal military potential (excepting missile capabilities, which will be discussed below) in the real world.

Considering first the map portion, it will be seen that map 6 is divided into several continental areas overlaid with a small scale grid 8 of cells 9 and a ocean portion overlaid with a larger scale grid 10 of cells 11. Each of the continental areas comprises a "region" or is further subdivided into one or more "regions" (each typically designated 12), which regions correspond roughly to the major geographical divisions of the world: North America/Central America, South America, Europe, Africa, Northern Eurasia/Far East, Middle East-/Southern Asia, and Southeast Asia/Oceania. The regions are uniquely identified by some indicia, so that they may be easily distinguished on the board 2; in the preferred version of the game, each of the regions is colored with a different background color. Each of the regions 12 itself is divided into designated nations (typically identified as 14). As noted, the nations 14 are designed such that each represents a viable military entity and geographical area. The size of each nation 14 (as shown by the number of cells in the small grid 8 that are contained within the boundaries of the nation 14) is intended to generally reflect the geographical size of the particular nation in the real world, which in turn is a factor the ability of a belligerent nation to conquer a target nation or in that nation's ability to defend itself against attack. Each of the nations 14 is represented by an identifying label; in the preferred version shown in the FIGURES the label or indicia is a three letter code 16 which has been selected for easy identification by the players. For instance, "EUS" stands for Eastern United States, "MEX" stands for Mexico and "CAM" stands for Central America.

The number of regions 12, and the number of nations 14 within each region 12, may be varied from that shown. Normally there will be between two and twenty regions 12, preferably about five to ten, With the most preferred version of seven being illustrated. The fewest numbers of regions 12 simulate a world in which there is a concentration of a few powers while the largest numbers of regions 12 simulated a world which is fragmented into numerous small regions; while these are quite feasible scenarios and lead to an enjoyable game, the preferred middle range of regions 12 simulates the most representative current world situation. Similarly, the number of nations 14 within each region 12 can be varied with the number generally being two to twenty, with six to twelve being preferred. Since as will be seen the game proceeds by capture, acquisition or destruction of individual nations 14, with fewer nations 14 the game generally proceeds more rapidly while with a larger number of nations 14 the game proceeds more slowly. There need not be an equal number of such nations 14 in each region 12, but the ratio of numbers of nations 14 between the largest region 12 and the smallest should not exceed 2:1, and preferably not exceed 3:2. In the embodiment illustrated, the number of nations in all the regions are equal.

Within each nation 14 are indicators of the offensive and defensive capabilities of that nation. The offensive capability is indicated by the number of cells 9 within the borders of the nation 14, since each cell 9 can contain one piece 32 representing an army. As will be seen, the larger number of armies 32 within a nation 14, the greater its capability to attack and conquers its neighbors. Defensive capabilities are illustrated not only by the number of army- 32-containing cells 9 (large numbers of armies deter attack) but also by the presence in some countries of one, two or three cells 9' labeled with special indicia 18, in this case circled stars. Each of these labeled cells represents a missile site, with the number of missile sites representing the relative defense capability of that particular nation with respect to other nations. It will be noted that some of the nations contain no labeled cells 9', indicating that their missile capabilities are inferior to those nations 14 which have one or more missile sites 18 indicated.

The ocean regions are also subdivided using a larger scale grid 10 of cells 11. There are no military strength indications in any of the ocean cells 11, since the primary purpose of the ocean cells is to provide transport routes for a player representing one nation 14 to attack another nation. For convenience if desired, one can label each of the ocean cells 11 with an identifying label such as numbers or letters, but such will be only for identifying purposes to expedite the flow of the game and will not represent any political or military factor in the game. Further, although it cannot be readily illustrated in the FIGURES, the game rules specify that the two land cells 9 representing respectively the geographical location of the Panama Canal and the Suez Canal are both considered to be open at all times so that the ocean cells 11 adjacent to each of those land cells 9 are considered to be joined for purpose of creating naval transport routes.

Considering then the border path 4, it will be seen that within this path are a plurality of spaces 20 (here shown as circles), most of which contain the identifying labels corresponding to nations 14 labeled on the map, with one space 20 for each of the labeled nations. In an actual board, each of the spaces 20 will preferably have the same unique indicia (for instance, same background color) as the respective nation 14 has on the map, and the spaces representing nations 14 in a region 12 will preferably be grouped together in the border path 4. For instance, it will be noticed that in the upper left hand portion of the board 6 all of the national spaces 20 of the North American/Central American region 12 are grouped together. In another alternative, the spaces 20 may be arranged in alphabetical order by name of each nation 14 to facilitate identification of each space 20 by the players.

Interspersed along the path 4 are additional special spaces 22 containing unique indicia, in this case numbered stars. In a preferred embodiment, where the spaces 20 are grouped by region 12, the special spaces 22 are situated so as to separate the grouped spaces 20 by designated continental region 12, The purpose of these special spaces 22 will be described below.

It will be evident that while the board 2 has been described above in terms of the preferred embodiments showing the cells 9 and 11 of the grids 8 and 10 in the shape of hexagons in the map and showing circles for individual spaces 20 and 22 within the border path 4, the board need not be limited solely to such shapes. Any space filling type of shape for the map grid 8 may be used, such as squares, rectangles or triangles. Similarly, any desired shape may be used for national spaces 20 and special spaces 22 along the border path 4, including irregular shapes. For instance, each of the national designation spaces 20 in the path 4 could be drawn to approximate the real shape of the geographical area itself. Also, the special spaces 22 on the path 4, here illustrated as circles with numbered stars therein, could be some other form of unique indicia, such as circles of different colors or the like. The particular type of designation is not important as long as the board accurately reflects the elements described, regardless of the actual indicia used to indicate those elements.

The remaining open areas on the board not included within the border path 4 or the map 6 have no significance in the game. They may be used for decoration, printing of all or a portion of the game rules, or may be left partially or entirely blank.

Turning now to the play of the game, the game is designed to preferably accommodate two or more players, preferably two to eight. Players may if desired form themselves into teams so that each team plays as a single player.

A "bank" (simply a holding area off the board, not shown) is formed which initially contains all of the pieces of the game. Each player is issued a single first playing piece 24 which is that player's "marker" or "token" to be used in progressing around the border path 4. These markers 24 represent the progress of the game and are confined to the border path 4; they are not used on the map 6 itself.

Also, each player is issued a set of numbered tiles 26. These tiles 26 are used by each player to determine the distance he or she moves along the border path 4 during each turn in the progress of the game. There are preferably nine tiles per set, eight of which have a separate number from "2" through "9". The remaining tile, which would otherwise be for the number "1" (this tile designated 26' when referred to individually), has thereon a special non-numerical design such as a star 28 and is referred to herein as the "unique tile". Each of the players is also initially issued a number of second playing pieces 32 representing armies. There are also a number of pieces 40 which are used to represent navies and additional pieces 32 (referred to as 32') which are used to designate neutral armies. During the play of the game a player is allotted a maximum of fifty army pieces 32 and twenty navy pieces a. Conveniently, each of the sets of army pieces 32 and navy pieces a will be a separate color for each player with the neutral army pieces 32' being of a color different from those used by any of the players.

There are two other pieces (respectively designated 36 and 38) representing nuclear annihilation of a nation 14 (piece 36 to be placed on the nation's space 20 on the path 4) and "doubling." The purpose of the doubling piece 38 will be described as the play of the game is described.

Prior to starting the play of the game, each player receives his or her initial set of tiles 26 as well as the playing piece 24 for that player. Each player also receives a number of army pieces 32 equal to the number of regions 12. The tiles 26 are laid out face up in front of the player. One player is designated as the starting player; this designation may be determined in any convenient manner, such as the roll of a die or the like. The first player places one of his or her army pieces 32 in a cell in any empty nation 14 in a region 12 and the remaining players follow in rotation. This rotation is continued until each player has an army piece 32 in one nation 14 of each region 12. A neutral army piece 32' is then placed in each of the remaining empty nations 14 in each region 12. The first player then places his game token 24 on an empty starred circle 22 in the border path, and each of the remaining players follows by placing his or her marker on a different unoccupied starred circle 22.

All unused playing pieces representing armies, navies, nuclear annihilation or doubling are placed in the "bank" and issued as indicated below in the play of the game.

To play the game, each player in succession selects one of the his or her tiles 26 and moves his or her playing token 24 along the border path 4 across the number of special spaces 22 and national spaces 20 indicated by the number on the tile 26 selected. That tile 26 is then turned face down and the number on that tile becomes temporarily unavailable for further use during the game until all of the player's other tiles 26 have been used. If the player is playing his or her unique tile 26', the player moves one space and then immediately receives a second turn. The unique tile 26' is turned face down when used in the first turn in the same manner as with the other tiles 26, and the second turn utilizes one of the remaining face-up tiles 26. If the unique tile 26' is the last face-up tile played, then since all tiles 26 are turned back face up after the last has been played, the unique tile then be played twice in succession if desired. (Replaying the unique tile 26' does not produce a third turn, however.)

If during the movement along the path 4, the player's token 24 reaches a special space 22 while moving, the player may continue moving along the path 4 or may immediately jump his or her playing token 24 to any unoccupied special space 22 on the path 4 and continue moving from that point for the remainder of the number of steps indicated by the played tile 26. If the number on the tile 26 causes the player's marker 24 to terminate its move on a special space 22, however, no jump to another special space 22 is permitted on that turn. However, when the next turn begins the player may proceed normally along the path 4 or may immediately jump to an unoccupied special space 22 and proceed from that point. On each subsequent move in rotation, the player chooses another face-up numbered tile 26 and moves the number of spaces 20 and 22 designated by the selected tile 26. Movement may be in either direction along the path 4; the player need not progress in the same direction on each subsequent turn, but may not reverse direction during a single turn, except that if a player reaches a special space 22 and jumps to a second special space 22, the player may continue from the second special space 22 in either direction along the path 4. Once all the available tiles 26 have been turned face down, they are all turned face up again as a group and the player resumes play on the next turn by selecting any tile 26. Tiles 26 need not be selected in any particular order, but rather the choice is left to the player of how many spaces he or she wishes to proceed and what different numerical space designations are left available to the player at any given time.

As a player's token 24 moves along the path 4 as indicated by the selected tile 26, the subsequent play of the game depends on whether the token 24 stops on a special space 22 or a national space 20, and whether the nation 14 designated by the space 20 is one owned by that player, owned by another player, neutral or unoccupied. If the player lands on a national space 20 for a nation he or she already owns, the player receives from the bank a total of up to three pieces (which may be army pieces 32, navy pieces 34 or, in some cases nuclear pieces 36, in any combination). Army pieces 32 must be placed on the nation 14 indicated by the space 20 on which the player's token 24 rests, but navy pieces 34 may be distributed to any allowable ocean cells 11 as described below. In addition, the player may then attack an opponent as described below. If the nation 14 is owned by an opponent, the player is eliminated from the game. If the nation is neutral (occupied by a neutral army 32') there is no further action during that turn and the play proceeds to the next player. If the nation is unoccupied, the player immediately acquires that nation. (Since all nations 14 start as owned or neutral, a nation 14 becomes unoccupied during the game when the nation's owner is eliminated from the game.) An army piece 32 of the player's color is obtained from the bank and placed on the country to indicate ownership. The player also receives from the bank an additional total of up to three pieces as described above for owned nations 14. If the player's piece 24 terminates on a special space 22, the player receives up to fourteen army pieces 32 from the bank and must place two of those pieces in nations 14 he or she owns in each continental region 12. If the player does not own a nation 14 in a given continental region 12, no pieces for that continental region 12 are obtained from the bank. This aspect of the game continues throughout as players add more and more armies 32 to the nations 14 they own and navies 34 to form naval forces and paths. Each army piece 32 is placed on a single cell within the nation 14 designated. When all of the cells within that nation 14 are occupied, no further armies can be obtained for that nation 14. Each navy is placed on an ocean cell 11 as described below.

During the course of play, a player moving along the border path 4 is eliminated from the game if his or her marker 24 on a turn must stop on a space 20 or 22 occupied by another player's token 24, a space 20 designating a nation 14 which has been the subject of nuclear annihilation (marked with a piece 36) or a space 20 designating a nation 14 owned by an opponent. If the tiles 26 remaining available to the player are such that the player can make no move along the border path 4 without terminating on one of these types of spaces, the eliminated player must leave his or her playing token 24 at the current spot on the border path 4 and return all army and navy tokens 32 and 34 as well as doubling pieces 38 back to the bank and retires from the game.

Further, during the course of movement along the path 4, a player cannot cross over another token 24 unless every other possible move available with the player's remaining available tiles 26 would force the player to end the token movement on a space 20 which would result in the player's elimination from the game, or unless the player has no remaining tiles 26 which would allow movement without passing over another player's token 24. It does not matter whether the token 24 represents a current player or one who has previously been eliminated from the game. Thus, the player with a choice of movements based on different tiles 26 must select the movement which will result in not crossing any opposing tokens 24, or if that is not possible, then crossing the minimum possible number of opposing tokens 24.

Upon receiving navy pieces 34 from the bank during the play of the game, each player places such navies 34 on any unoccupied ocean cell 11 or any ocean cell 11 which already contains one or more of that player's navies 34. An ocean cell 11 may contain as many of a player's navies 34 as desired, but may not contain navies 34 of more than one player. The placement of the navies 34 on the ocean cells 11 must be in a pattern such that a naval path beginning at one of the player's nations 14 and leading in the direction of a opponent's nation 14 is created or extended. A naval path is defined as any path of contiguous ocean cells 11 each containing at least one of a player's navies 34. A naval path may be of any length and configuration; it need not represent the shortest route between two nations 14 on opposite sides of an ocean area. When nations 14 are close together, an ocean path may consist of a single ocean cell whose different sides touch both nations. For the purposes of the game, the eastern and western edges of the map 6 are considered to be continuous so that a player's naval path extending to the eastern or western edge of the board will "wrap around" and continue on a contiguous ocean cell at the other side of the board. The north and south edges of the map are not considered to be contiguous, however. Also, as noted above, there is considered to be a continuous naval path through the land cells representing respectively the Panama Canal and Suez Canal.

As noted, a player is limited to a maximum of fifty army pieces 32 and twenty navy pieces 34 at any time. A player cannot voluntarily destroy any of his or her armies or navies. However, a player can elect to inflict nuclear annihilation on one of his or her own nations 14 or water cells 11 to make the armies or navies in the annihilated site available for future use.

During progress of the game, each player also receives nuclear pieces 36 in a number determined by indicia 18 in the nation 14 on which the player's token 24 has landed in the path 4. The number of pieces 36 to be obtained on each turn is determined by the number of missile site designations 18 in the particular nation 14, with one nuclear token being obtained per missile site designation. If the nation 14 has no missile site designations 18, no nuclear piece 36 is received.

A player whose marker 24 in turn terminates on a national space 20 for a nation 14 that that player owns may if desired immediately attack an opponent's nation 14 or ocean cell 11. In order to conquer another nation 14, a player must identify the nation 14 that he or she owns and is attacking from (which need not be the nation designated by the space 20 on which the marker 24 resides) as well as the nation 14 of the opponent that is to be attacked. The two nations must be touching or must be connected by a naval path. The attacking player must have at least two armies 32 in the attacking nation 14 in excess of the number of defending armies 32 that the attacked nation 14 has. Thereupon all of the armies 32 are removed from the attacked nation 14 and returned to the bank. An equal number of armies 32 are removed from the attacking nation 14 and also returned to the bank. The attacking player must then move at least one of his or her excess armies 32 into the attacked nation 14 to indicate conquest of that nation; at least one excess army 32 must remain in the attacking nation 14. The distribution of number of armies 32 in each of the two nations is otherwise up to the player. Thereafter, the armies 32 in the conquered nation 14 can be used in subsequent turns to attack and conquer further nations 14 which are in contact with or joined by a naval path to the newly conquered nation 14.

As with the conquest of nations, a naval force in one ocean cell 11 that contains at least two navy pieces 34 in excess of a rival player's naval force in an adjoining ocean cell 11 can attack and conquer the opponent's navy in that adjoining cell. After the attack the conquered navy pieces 34 are removed and returned to the bank as are an equal number of the attacking navy pieces 34. The excess attacking navy pieces 34 may be left by the attacker in the original ocean cell 11 or some or all of them may be moved to the conquered cell. Except for this maneuver or by annihilation, however, navy pieces 34 cannot be moved from the ocean cell 11 on which they were originally placed.

A player may blockade a rival player's nation 14 by owning or conquering all of the nations 14 adjacent to the rival player's nation 14 and by having naval forces in all of the ocean cells 11 (if any) which also border on the rival's nation 14, so that the rival nation 14 is completely surrounded by the opponent's armies 32 and/or navies 34. The first player then declares the blockade and all of the rival's armies 32 are removed from the blockaded nation 14 and returned to the bank. One of the blockading player's army pieces 32 is obtained from the bank and placed in the now empty nation 14, signifying that the blockading player now owns the blockaded nation 14. A nation 14 surrounded by neutral nations 32' is not considered blockaded, however. Also, since as discussed above, the northern and southern "polar" edges of the map 6 do not constitute playing areas, a nation 14 which borders on a polar edge will be blockaded if all of the maps areas adjacent to it are occupied, notwith-standing that there is no opponent's force on the polar side.

A player may also launch a nuclear attack against a nation 14 or an ocean cell 11 by identifying that target. An ocean cell 11 requires only a single nuclear piece 36 available to annihilate all the opponent's navies 34 within that cell. A nation 14, however, requires a number of nuclear pieces 36 which is determined by the number of missile sites 18 designated on the map 6 for that nation 14. A nation 14 with no missile sites 18 will be annihilated by a single nuclear piece 36. However, a nation 14 having one, two or three missile sites 18 will require a corresponding number of nuclear pieces 36 in the possession of the attacker to annihilate the nation 14. Once a nation is deemed to have suffered nuclear annihilation, a single nuclear annihilation piece 36 is placed on that nation's space 20 in the border path 4 and the nation 4 remains annihilated for the remainder of the game. (The fact that any player's playing token 24 happens to be resting on that nation's space 20 in the border path 4 at the time of annihilation is of no consequence to that player.) Since only a single nuclear piece 36 is used to indicate nuclear annihilation, if the attacking player has needed more than one nuclear piece 36 to accomplish the annihilation, the excess nuclear pieces 36 are then returned to the bank.

Once a player has conquered all of the individual nations 14 within a single continental region 12, he or she receives a doubling piece 38 designated for that region 12. Since of course only one player can own all of the nations 14 in a region 12 at a given time, there is only a single doubling piece 38 for each continental region 12. Thereafter, on the player's succeeding turns he or she receives double the number of armies 32, navies 34, or nuclear pieces 36 to which he or she would otherwise be entitled. Obtaining additional doubling pieces 38 for conquering other continental regions 12 results in cumulative doubling of the number of armies 32, navies 34 and nuclear pieces 36 obtained.

If one player conquers or annihilates the last nation 14 that a rival player has, that rival is eliminated from the game. The attacking player then receives all of the doubling pieces 36 which the rival player has previously accumulated and all of the rival player's tiles 26 which are currently face up. The attacking player thereafter can use those "captured" tiles 26 in addition to his or her own tiles 26 and will continue play with the total number of tiles 26 in the normal manner.

The play proceeds until one player is the only survivor and all of the other players have been forced out of the game by having all of their nations 14 conquered or annihilated.

The simulation of the regional alliances and the power building as against other regions will be seen from the ability of a player to double his or her arsenals by acquiring all of the nations 14 within a region 12. Thus, as players secure their desired regions 12, they become militarily much stronger and their ability for further conquest of neighboring nations 14 and ultimately regions 12 is enhanced. This closely simulates the real world situation, where alliances of neighboring nations or individual nations with large areas are seen to be much stronger militarily than their separated and isolated neighbors. For instance, a prototype regional group such as the North Atlantic Treaty Organization is far stronger than its individual members would be separately. Similarly, the Middle Eastern Coalition Partners in the recent Persian Gulf War collectively represented much greater strength than would have been possible from the individual nations if acting alone.

It will be evident there are numerous embodiments of the board game of this invention, which not expressly described, are clearly within the scope and spirit of the invention. The above description is therefore intended to be exemplary only and the scope of the invention is to be limited solely by the appended claims.

I claim:

1. A board game apparatus simulating international military conflict, which comprises:

a playing board comprising a map illustrating at least a portion of each of the principal oceans and nations of the world, said map containing indicia assigning each of said nations to one of a plurality of continental regions;

the ocean portion of said map being overlaid by first network of cells and the land portion of said map being overlaid by a second network of cells, each cell in said ocean network simulating coverage of a proportionately larger geographical area than each cell in said land network;

at least some of said nations illustrated on said map containing indicia designating missile facilities therein; and said map being bordered by a path comprising a first plurality of spaces each identifying one of said nations and containing corresponding continental region indicia for each of said nations and regions and a second plurality of spaces denoting enhanced movement along said path;

first playing pieces for individual movement by each player along said path in the course of said game; second playing pieces representing individual military or naval forces in a nation or ocean;

third playing pieces designating nuclear annihilation of a nation; and designators determining each player's permitted movement along said path at each point in said game;

each of said first pieces when moved along said path in response to the indication of one of said designators determining a military opportunity of the player represented by said piece with respect to the other players, said opportunity being determined by the path space on which said player's first piece resides after said movement and the number of said second pieces, third pieces, cells and missile facilities then associated with any nation indicated by said path space.

2. A board game apparatus as in claim 1 wherein said second spaces in said path also represent opportunities for players to enhance their military and naval forces.

3. A board game apparatus as in claim 1 wherein there are 2-20 continental groups.

4. A board game apparatus as in claim 1 wherein there are 5-10 continental groups.

5. A board game apparatus as in claim 1 wherein each continental group contains 2-20 nations.

6. A board game apparatus as in claim 5 wherein there are 6-12 nations within each continental group.

7. A board game apparatus as in claim 6 where there are the same number of nations in each continental group.

8. A board game apparatus as in claim 1 wherein said indicia designating regional grouping of said nations on said map and path comprises color.

9. A board game apparatus as in claim 1 further comprising fourth playing pieces each representing a continental region and, when possessed by a player, enhancing that player's acquisition of said first, second and third playing pieces during subsequent play of the game.

10. A board game apparatus as in claim 1 wherein said designators of movement comprise a set of numbered devices, each device having a different number thereon.

11. A board game apparatus as in claim 10 wherein said set of numbered devices also includes at least one additional device having non-numerical indicia thereon indicating enhanced movement along said path.

12. A board game apparatus as in claim 1 wherein said second network of cells overlaying said land areas also indicates relative military strengths of said nations within said network.

* * * * *